US008992250B1

(12) United States Patent
Hosler, Sr.

(10) Patent No.: US 8,992,250 B1
(45) Date of Patent: Mar. 31, 2015

(54) CLOCKABLE CABLE ADAPTER

(71) Applicant: MegaPhase, LLC, Stroudsburg, PA (US)

(72) Inventor: Robert C. Hosler, Sr., East Stroudsburg, PA (US)

(73) Assignee: MegaPhase, LLC, Stroudsburg, PA (US)

( * ) Notice: Subject to any disclaimer, the term of this patent is extended or adjusted under 35 U.S.C. 154(b) by 173 days.

(21) Appl. No.: 13/841,320

(22) Filed: Mar. 15, 2013

(51) Int. Cl.
*H01R 9/05* (2006.01)
*H01R 13/622* (2006.01)

(52) U.S. Cl.
CPC ..... *H01R 13/622* (2013.01)
USPC ..... 439/582; 439/322

(58) Field of Classification Search
CPC . H01R 2103/00; H01R 9/0521; H01R 9/0518
USPC ..... 439/63, 322, 578–585
See application file for complete search history.

(56) References Cited

U.S. PATENT DOCUMENTS 2,813,144 A 11/1957 Valach
3,432,798 A * 3/1969 Brishka ..... 439/322
3,528,052 A * 9/1970 Brishka ..... 439/582
4,368,940 A * 1/1983 Sugiura ..... 439/170
4,687,279 A * 8/1987 Holland et al. ..... 439/578
5,277,590 A 1/1994 Thomas et al.
5,439,386 A * 8/1995 Ellis et al. ..... 439/322
5,971,770 A 10/1999 Richmond
6,126,482 A * 10/2000 Stabile ..... 439/582
6,283,790 B1 * 9/2001 Idehara et al. ..... 439/582
6,287,144 B1 9/2001 Baffert
7,165,974 B2 * 1/2007 Kooiman ..... 439/63
7,270,569 B2 * 9/2007 Petersen et al. ..... 439/582
7,381,089 B2 6/2008 Hosler, Sr.
7,419,403 B1 * 9/2008 Paynter ..... 439/578
7,530,841 B2 5/2009 Henningsen
7,621,778 B1 * 11/2009 Paynter et al. ..... 439/584
7,753,725 B2 * 7/2010 Henningsen ..... 439/578
8,221,161 B2 * 7/2012 Leibfried, Jr. ..... 439/578
2012/0252267 A1 10/2012 Nugent

* cited by examiner

*Primary Examiner* — Thanh Tam Le
(74) *Attorney, Agent, or Firm* — Chadbourne & Parke LLP; Neal J. McLaughlin

(57) ABSTRACT

A clockable cable adapter includes a termination body, a clocking body and a retaining member configured to retain the clocking body to the termination body. Rotation of the clocking body and an external adapter partially engaged therewith is permitted, while rotation of the clocking body and external adapter is fixed when the clocking body is fully engaged with the external adapter. A cable assembly includes a cable fixed to a clockable adapter and an external adapter engaged with the clockable adapter.

14 Claims, 7 Drawing Sheets

CLOCKABLE CABLE ADAPTER

TECHNICAL FIELD

This invention relates to adapters configured for connection to coaxial cables and configured for transmission of high frequency signals.

DESCRIPTION OF RELATED ART

Coaxial cables for transmission of high frequency signals are in widespread use in many military and commercial fields, including research and design laboratories, aviation and land-based applications. Cables configured for transmission of high frequency signals are designed to meet various strength, interference shielding and signal propagation requirements, which vary by application. High frequency cables typically sacrifice flexibility and size in order to meet these requirements.

However, high frequency cables are increasingly being used in space-limited applications. In order to fit high frequency cables within constricted areas, angled adapters may be installed at the ends of high frequency cables to provide a change of direction in a relatively small space.

Such angled connectors are conventionally permanently attached to the cable to maintain signal quality and/or robustness. Cables may be fitted with angled connectors at one or both ends. In specifying a cable with two angled connectors, the angle of the connector as well as the relative angle between connectors must be specified. For example, a cable may have right angle (90°) connector at both ends, with one connector at a twelve o'clock position as viewed down a length of the cable and with the other right angle connector at a three o'clock position in the same view. Therefore, when angled adapters are installed at both ends of a high frequency cable, the orientation of the angled adapters relative to one another must be tightly controlled and pre-specified. Cables having angled connectors permanently installed at the ends thereof are typically specially manufactured for each specific application and typically may not be reused in a different application, increasing manufacturing costs and limiting availability.

Drawbacks also arise in the installation of such cables into their intended installed position in that is it often awkward to install a cable with one or more permanently attached angled adapters. Therefore, there exists a need for an improved adapter that addresses these concerns.

SUMMARY OF THE INVENTION

This invention related to clockable cable adapters and cable assemblies including clockable cable adapters.

In general, in one aspect, the invention features a clockable cable adapter, including a termination body configured to receive a cable and to be fixable thereto, the termination body including an annular surface and a retaining member engagement surface, a clocking body rotatably installed about the annular surface of the termination body, the clocking body including threads configured to engage an external adapter and to draw the external adapter toward the clocking cable adapter and a retaining member fixedly installed about the retaining member engagement surface of the termination body and configured to retain the clocking body to the termination body while allowing the clocking body to rotate about the termination body, wherein the clocking body is configured to rotate about the termination body when partially engaged with the external adapter, and when the clocking body is fully engaged with the external adapter, at least one of the termination body and the retaining member contacts the external adapter thereby preventing rotational movement of the external adapter and the clocking body relative to the termination body.

Implementations of the invention may include one or more of the following features. The clockable cable adapter may further include a contact configured to engage an inner conductor of the cable and an inner contact of the external adapter a contact dielectric disposed around the contact and a contact retaining member configured to engage the contact dielectric and the termination body thereby fixing the contact relative to the termination body. At least one of the termination body and the retaining member may have an end surface extending in a direction away from an end of the cable further than an endmost surface of the clocking body. The termination body may have an outer surface knurled to receive at least one of a cable jacket and a stress relief. The clocking body may have an outer surface knurled to receive at least one of a cable jacket and a stress relief.

In general, in another aspect, the invention features a cable assembly including a cable including an inner conductor, a dielectric disposed around the inner conductor and a shielding around the dielectric an external adapter and a clockable adapter which includes a termination body fixed to the shielding of the cable, the termination body including an annular surface and a retaining member engagement surface, a clocking body rotatably installed about the annular surface of the termination body, the clocking body including threads configured to engage the external adapter and to draw the external adapter toward the clocking cable adapter and a retaining member fixedly installed about the retaining member engagement surface of the termination body and configured to retain the clocking body to the termination body while allowing the clocking body to rotate about the termination body, wherein the clocking body is configured to rotate about the termination body when partially engaged with the external adapter, and when the clocking body is fully engaged with the external adapter, at least one of the termination body and the retaining member contacts the external adapter thereby preventing rotational movement of the external adapter and the clocking body relative to the termination body.

Implementations of the invention may include one or more of the following additional features. A cable assembly may further include a second clocking adapter and a second external adapter. A cable assembly may further include a braided shielding around the shielding and a jacket around the braided shielding, the jacket extending over at least a portion of an outer surface of the termination body. The clocking body may have an outer surface and the jacket may extend over at least a portion of the outer surface of the clocking body. A cable assembly may further include a braided shielding around the shielding, a jacket around the braided shielding and a strain relief around at least a portion of the jacket, the strain relief extending over at least a portion of an outer surface of the termination body. The clocking body may have an outer surface and the strain relief may extend over at least a portion of the outer surface of the clocking body. The external adapter may be an angled adapter and rotation of the external adapter about the termination body may correlate to rotation of an output axis of the angled adapter relative to a plane through a major axis of the cable. The termination body may have an outer surface knurled to receive at least one of a cable jacket and a stress relief. The temination body may have an outer surface knurled to receive at least one of a cable jacket and a stress relief.

BRIEF DESCRIPTION OF THE DRAWINGS

The above mentioned and other aspects, features and advantages can be more readily understood from the following detailed description with reference to the accompanying drawings, wherein.

DETAILED DESCRIPTION

Cable adapters and connectors are described herein, with reference to examples and exemplary embodiments. Specific terminology is employed in describing examples and exemplary embodiments. However, the disclosure of this patent specification is not intended to be limited to the specific terminology so selected and it is to be understood that each specific element includes all technical equivalents that operate in a similar manner. Similarly, while some examples discussed herein concern coaxial cables, adapters and connectors, the present disclosure also relates to cables, adapters and connectors that are not coaxial, such as, for example, multiconductor cables, adapters and connectors.

Figure 1:
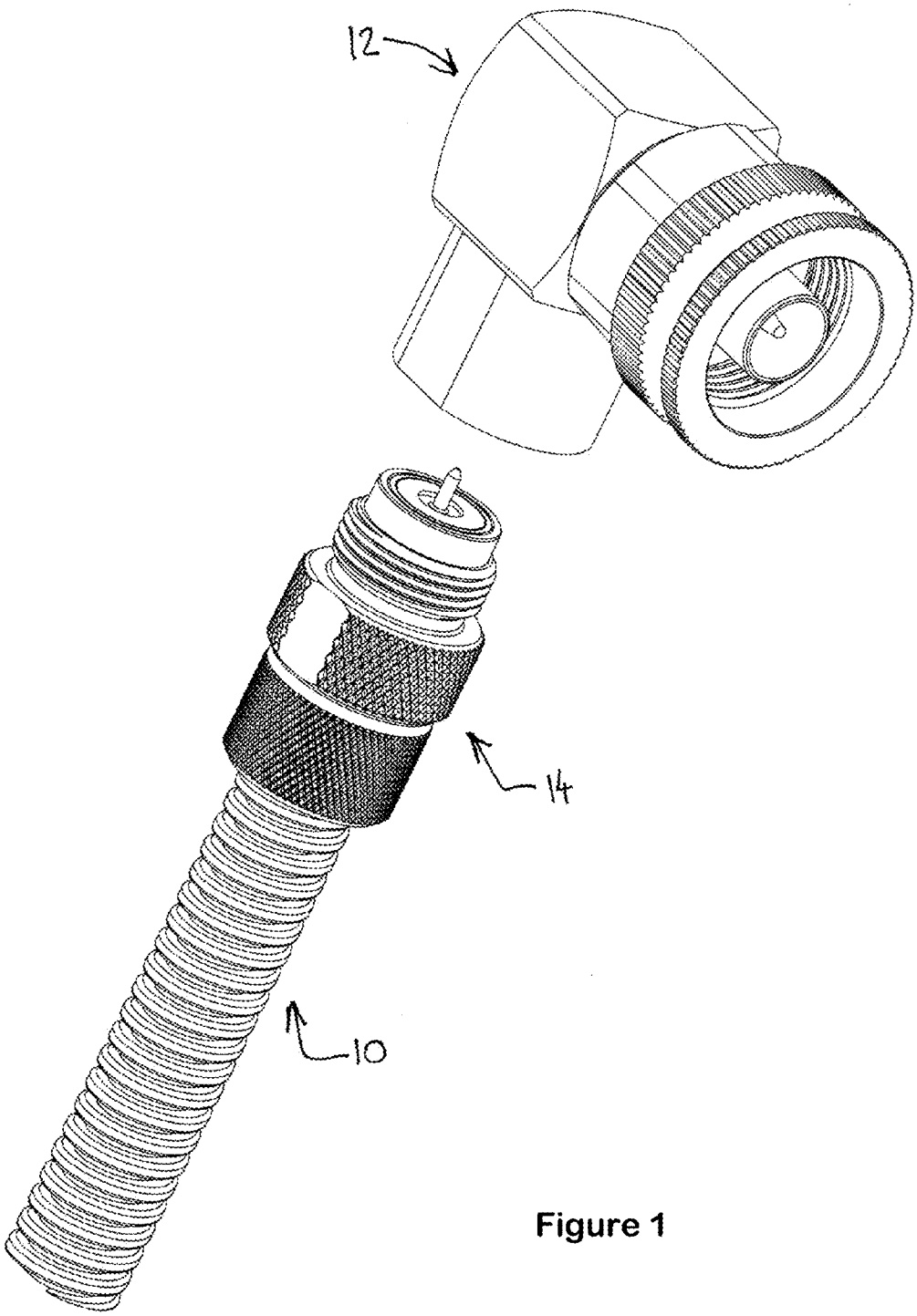
FIG. 1 is a perspective view of an unsheathed cable, a clockable adapter and an angled adapter in a disassembled configuration according to an exemplary embodiment of the present application.

In an exemplary embodiment, shown in FIG. 1, an unsheathed cable 10 and an angled adapter 12 are shown in a disassembled configuration. The unsheathed cable 10 is fitted with a clocking adapter 14.

Figure 2:
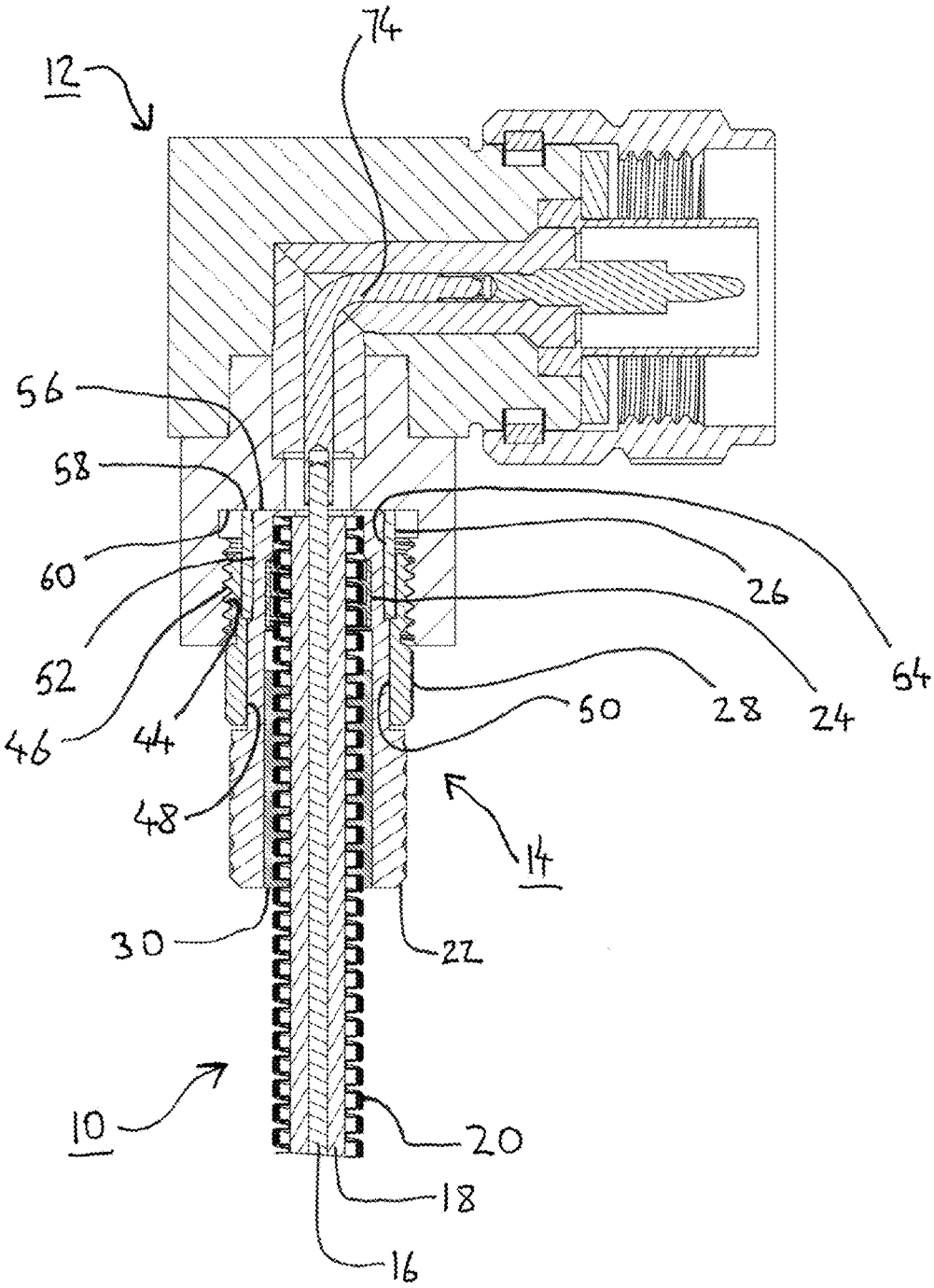
FIG. 2 is a cross sectional view of an unsheathed cable, a clockable adapter and an angled adapter in an assembled configuration taken along a plane which intersects a major axis of the cable according to another exemplary embodiment of the present application.

FIG. 2 shows a cross section of unsheathed cable 10 taken along a plane intersecting a major axis of the cable. Unsheathed cable 10 includes an inner conductor 16, a dielectric 18, and spiral shielding 20. The unsheathed cable 10 is terminated by a clockable adapter 14, which includes a termination body 22, a shielding engagement member 24, a retaining ring 26 and a clocking body 28. The spiral shielding 20 may be attached to the clockable adapter 14 first by threading the spiral shielding 20 into complementary threads of the shielding engagement member 24 and later fixing the components together via a solder joint 30. Shielding engagement member 24 may be configured with a "press-fit" engagement into an inner cable receiving bore of termination body 22.

Figure 3:
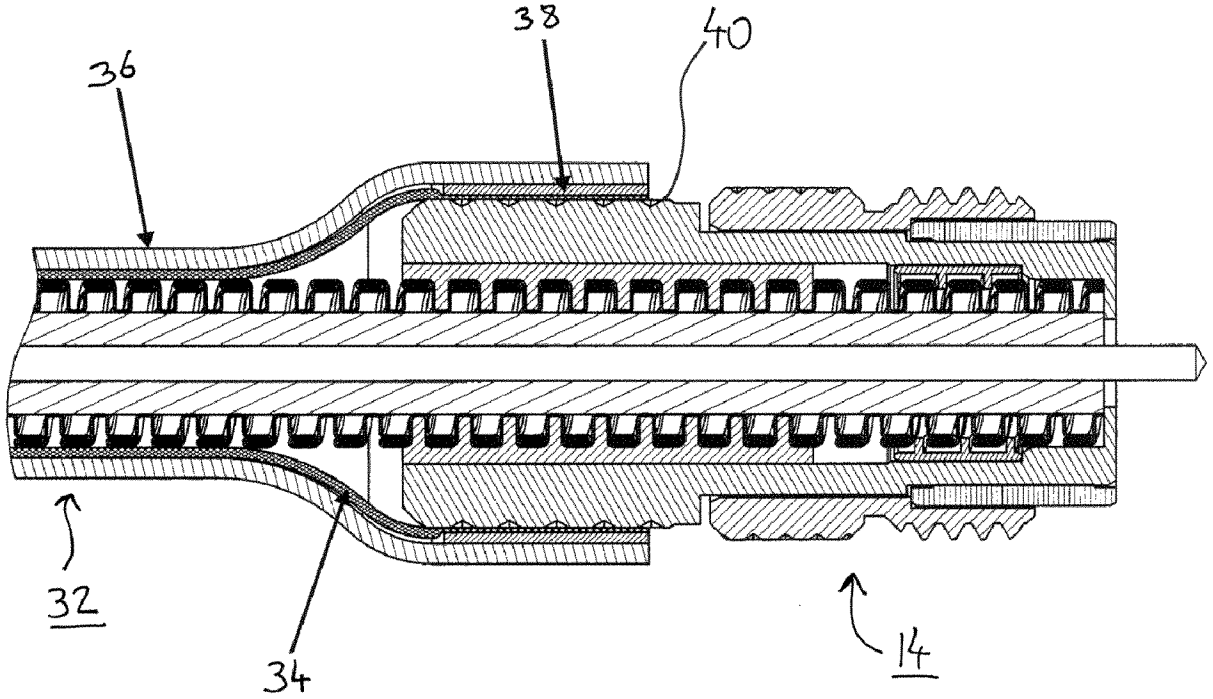
FIG. 3 is a cross sectional view of a sheathed cable and a clockable adapter taken along a plane which intersects a major axis of the cable according to another exemplary embodiment of the present application.
Figure 4:
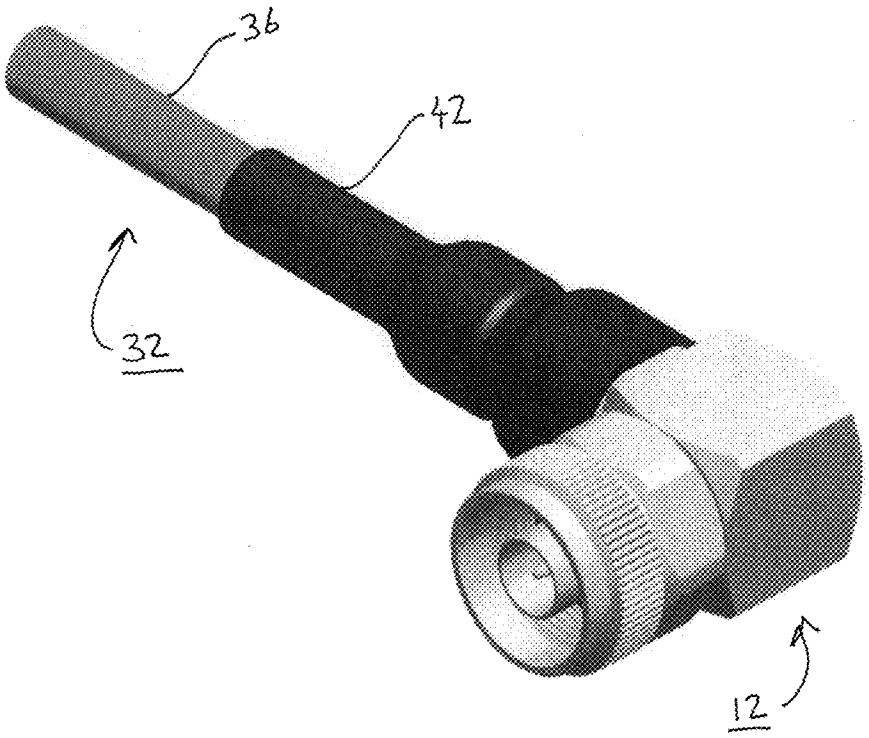
FIG. 4 is a perspective view of a sheathed cable, a clockable adapter and an angled adapter in an assembled configuration according to another exemplary embodiment of the present application.

In another example, shown in FIG. 3, a sheathed cable 32 may include a braided shielding 34 and an outer jacket 36. As shown, a crimp ring 38 may be crimped over the braided shielding 34 and a surface 40 of the termination body 22. The termination body 22 may be configured with a knurled surface 40 to improve the grip of the crimp ring 38. The cable jacket 36 may cover all or part of the braided shielding 34 and crimped crimp ring 38. Further, as discussed in more detail below, the cable jacket 36 may cover all or part of the clockable adapter 14 and angled adapter 12 installed on the clockable adapter 14. As another example, a strain relief 42 may be installed over the jacket 36 and all or part of the clockable adapter 14 and/or angled adapter 12. For example, when extended over at least a portion of the clocking body 28, a jacket 36 or strain relief 42 may act to prevent the clocking body from becoming unscrewed from an angled adapter, further fixing an installation angle therebetween.

Returning to FIG. 2, a clocking body 28 may include threads 44, which engage with mating threads 46 of an angled adapter 12. Of course, other features may be configured to engage the clockable adapter 14 and the angled adapter 12 instead of, or in addition to, threads. Further, it will be understood that while the description provided herein is provided in the context of a clockable adapter engaging an angled adapter, a clockable adapter according to the present invention may also be configured to engage an apparatus, another cable, a non-angled adapter, etc.

Figure 5:
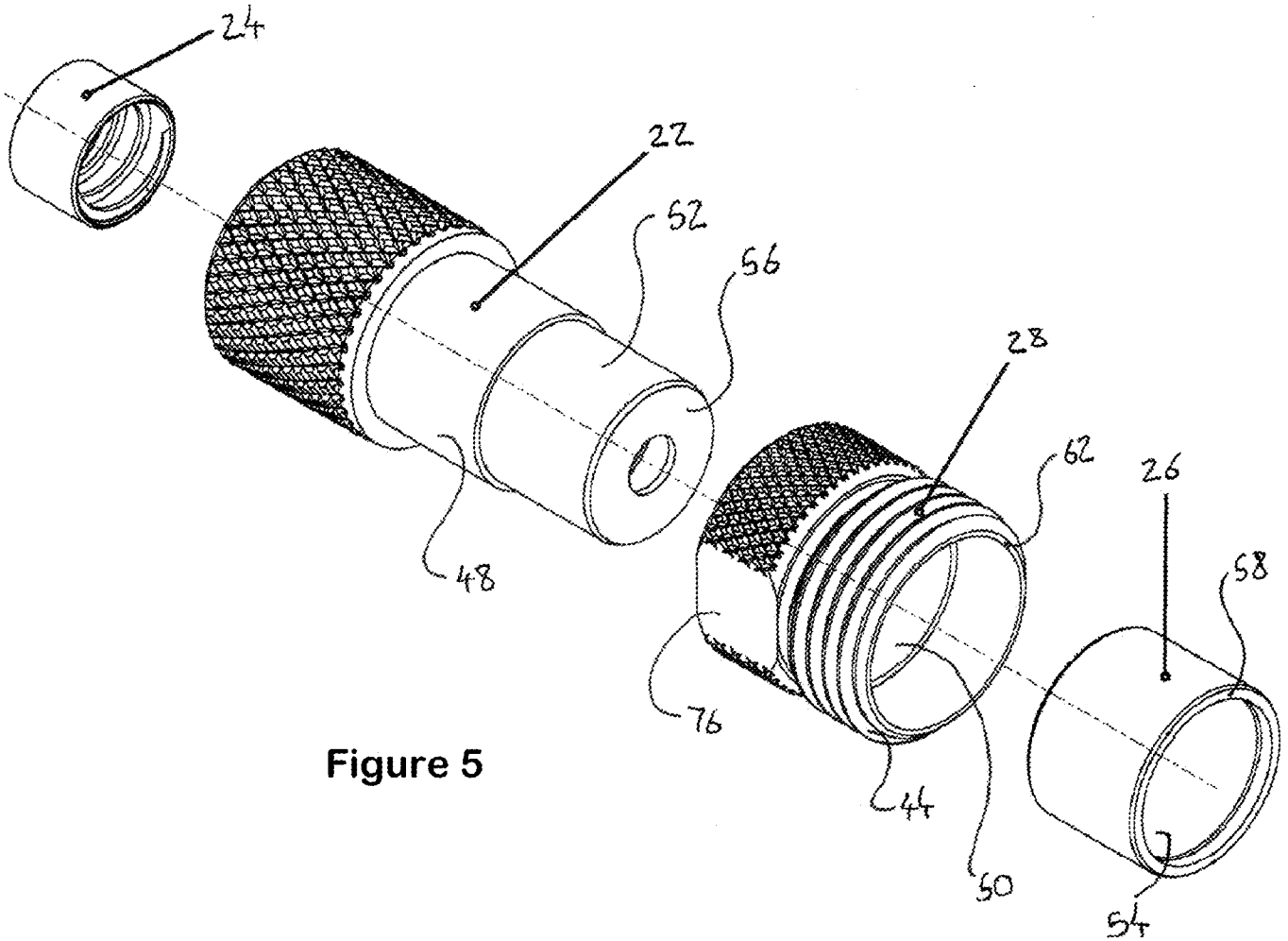
FIG. 5 is an exploded perspective view of a clockable adapter according to an exemplary embodiment of the present application.

As shown in FIGS. 2 and 5, the termination body 22 may further include an annular surface 48 about which the clocking body 28 is installed and is free to rotate. Clocking body may be configured with a complementary annular surface 50, which bears on annular surface 48. In the example shown, a major axis of the annular surface 48 is substantially coaxial with a major axis of the cable 10, although these major axes need not be configured in such an arrangement. For example, a major axis of the annular surface 48 of the termination body 22 may be configured parallel to, but offset from, a major axis of the cable 10. In another example, a major axis of the annular surface 48 of the termination body 22 may be configured at a non-zero angle (for example 45° or 90°) relative to a major axis of the cable, and optionally offset therefrom.

The termination body 22 may further include a retaining member engagement surface 52 configured to engage the retaining member 26. In one example, the termination body 22 includes an annular retaining member engagement surface 52 configured in combination with an inner bore 54 of the retaining member 26 to provide a "press-fit" between the two components. When installed on the termination body 22, the retaining member 26 holds the clocking body 28 captive on the termination body 22 about the annular surface 48 thereof. Accordingly, the clocking body is free to rotate about the termination body 22 and retaining member 26, but is prevented from coming free from them. The clocking body 28 may include one or more flats 76 configured to receive a wrench or other installation instrument.

As shown in FIG. 2, an angled adapter 12 is threaded onto the clocking body 28. A top surface 56 of the termination body 22 and/or a top surface 58 of retaining member 26 are configured to contact an inner end surface 60 of angled adapter 12 when the angled adapter 12 is fully threaded onto clocking body 28. However, when the angled adapter 12 is only partially threaded onto clocking body 28, the clocking body and angled adapter 12 are free to rotate together about the cable 10. It is only when the clocking body 28 is fully threaded into adapter body 12 that the angular relationship between the angled adapter 12 and the cable 10 becomes fixed, or "clocked." Clockable body 28 may be configured such that an end 62 thereof does not extend past the end surfaces 56 and 58 of the termination body 22 and retaining member 26, respectively, in order to ensure that the termination body 22 and/or the retaining member 26 contact the end surface 60 of the angled adapter 12 first, thereby fixing an installation angle of the angled adapter 12 on the cable 10.

Figure 6B:
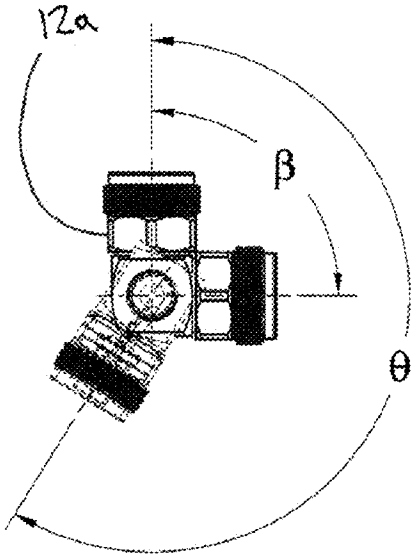
FIG. 6B is an end view of the unsheathed cable, clockable adapters and angled adapters shown in FIG. 6A in an assembled configuration according to another exemplary embodiment of the present application.
Figure 6A:
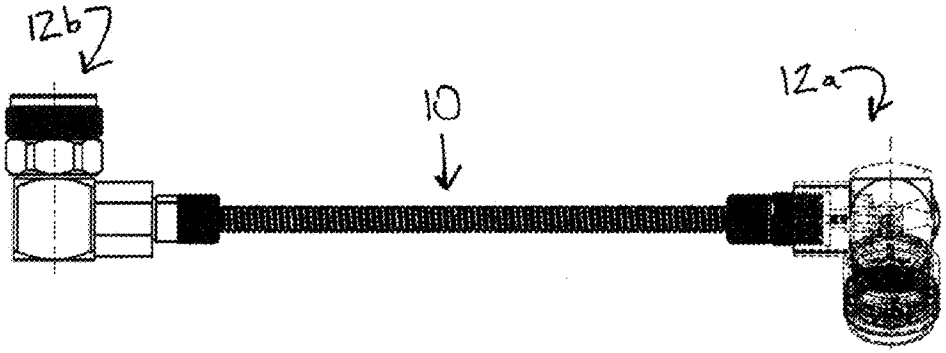
FIG. 6A is a side view of an unsheathed cable, clockable adapters and angled adapters in an assembled configuration according to another exemplary embodiment of the present application.

As shown in FIG. 6B, a view taken from a direction parallel to a major axis of cable 10, an installation angle θ of an angled adapter may be freely chosen while the angled adapter 12*a* and clocking body 28 are not fully threaded onto one another, and may be fixed at a final installation angle β by fully engaging the threads 44 and 46. FIG. 6A shows the cable 10 and angled adapters 12*a* and 12*b* of FIG. 6B from a side view and further illustrates the concept of relative installation angles between angled adapters 12*a* and 12*b* installed on either end of a cable 10.

Figure 7:
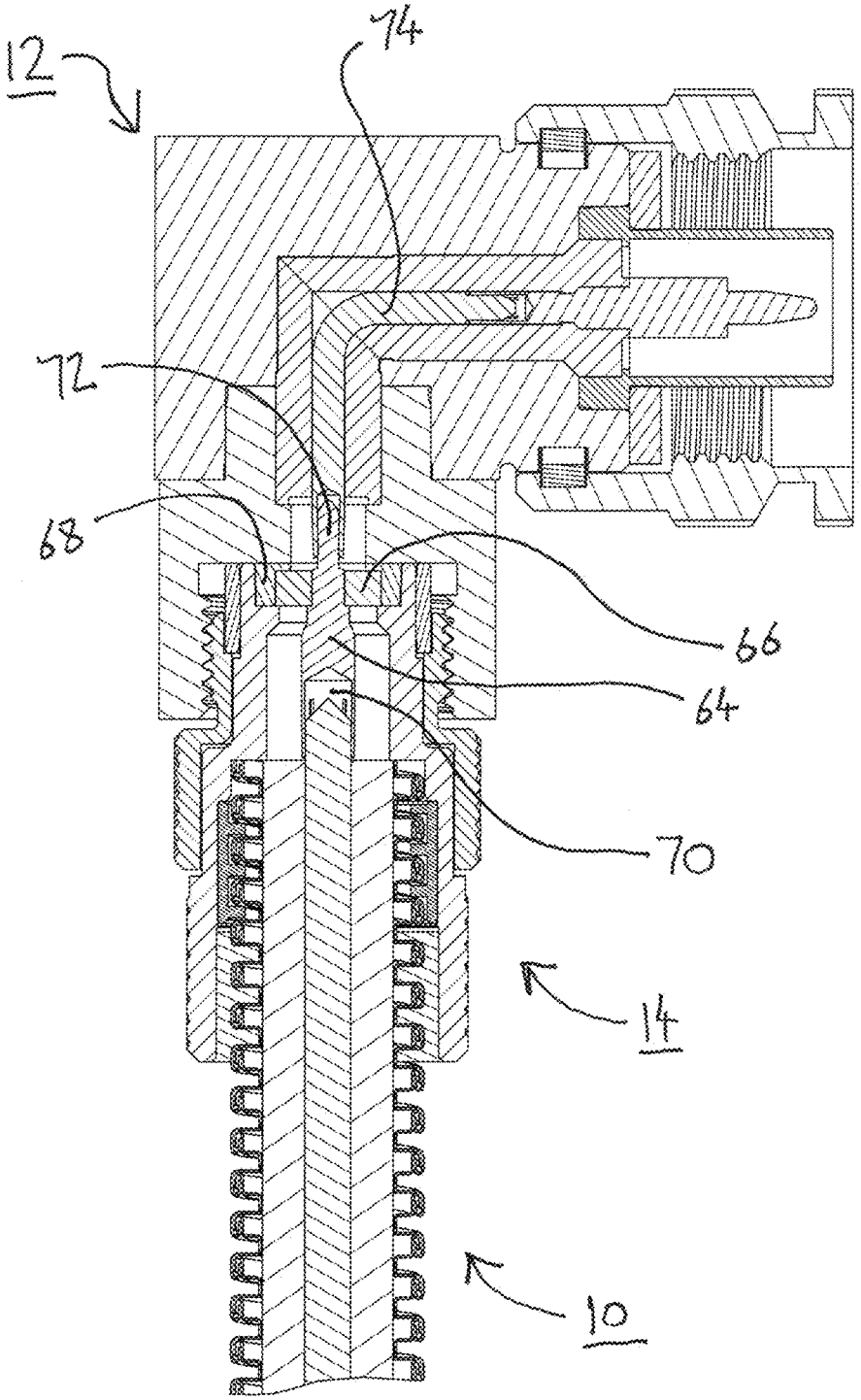
FIG. 7 is a cross sectional view of an unsheathed cable, a clockable adapter and an angled adapter in an assembled configuration taken along a plane which intersects a major axis of the cable according to another exemplary embodiment of the present application.

In another embodiment, shown in FIG. 7, a clockable adapter 14 further includes a contact 64, a contact dielectric 66 and a contact retaining member 68. In this example, the contact may include a female end 70 configured to engage with the inner conductor 16 of the cable 10 and a male end 72 configured to engage with an inner conductor 74 of the angled adapter. Contact retaining member 68 may be "press-fit" into an inner bore or termination body 22.

Materials for the various components may be chosen from among a wide range of suitable materials. In one example, termination body 22, retaining member 26 and clocking body 28 may be formed of passivated stainless steel, brass, beryllium-copper or phosphor-bronze (such as by machining or casting), contact 64 may be manufactured of beryllium-copper or phosphor-bronze, dielectric 18 and contact dielectric 66 may be formed of (such as by machining or molding) PTFE (Polytetrafluoroethylene, a brand of which is Teflon), etc. Metal components may be plated with other metals such as nickel or gold.

In addition, the embodiments and examples above are illustrative, and many variations can be introduced on them without departing from the spirit of the disclosure or from the scope of the appended claims. For example, elements and/or features of different illustrative and exemplary embodiments herein may be combined with each other and/or substituted for each other within the scope of this disclosure. As another example, two or more of the various components described herein may be combined into one or more consolidated components or one of the various single components described herein may be provided as two or more sub-components.

What is claimed is:

1. A clockable cable adapter, comprising:

a termination body configured to receive a cable and to be fixable thereto, the termination body including an annular surface and a retaining member engagement surface;

a clocking body rotatably installed over the termination body and upon the annular surface of the termination body, the clocking body including threads configured to engage an external adapter and to draw the external adapter toward the clocking cable adapter; and a retaining member fixedly installed over the termination body and upon the retaining member engagement surface of the termination body and configured to retain the clocking body to the termination body while allowing the clocking body to rotate relative to the termination body, wherein the clocking body is configured to rotate relative to the termination body when partially engaged with the external adapter, and when the clocking body is fully engaged with the external adapter, at least one of the termination body and the retaining member contacts the external adapter thereby preventing rotational movement of the external adapter and the clocking body relative to the termination body.

2. The clockable cable adapter according to claim 1, wherein the cable includes an inner conductor and the external adapter includes an inner contact, and further comprising:

a contact configured to engage the inner conductor of the cable and the inner contact of the external adapter;

a contact dielectric disposed around the contact; and a contact retaining member configured to engage the contact dielectric and the termination body thereby fixing the contact relative to the termination body.

3. The clockable cable adapter of claim 1, wherein at least one of the termination body and the retaining member has an end surface extending in a direction away from an end of the cable further than an endmost surface of the clocking body.

4. The clockable cable adapter of claim 1, wherein the termination body has an outer surface knurled to receive at least one of a cable jacket and a stress relief.

5. The clockable cable adapter of claim 1, wherein the clocking body has an outer surface knurled to receive at least one of a cable jacket and a stress relief.

6. A cable assembly, comprising:

a cable including an inner conductor, a dielectric disposed around the inner conductor and a shielding around the dielectric;

an external adapter; and a clockable adapter comprising:

a termination body fixed to the shielding of the cable, the termination body including an annular surface and a retaining member engagement surface, a clocking body rotatably installed over the termination body and upon the annular surface of the termination body, the clocking body including threads configured to engage the external adapter and to draw the external adapter towards the clocking cable adapter, and a retaining member fixedly installed over the termination body and upon the retaining member engagement surface of the termination body and configured to retain the clocking body to the termination body while allowing the clocking body to rotate relative to the termination body, wherein the clocking body is configured to rotate relative to the termination body when partially engaged with the external adapter, and when the clocking body is fully engaged with the external adapter, at least one of the termination body and the retaining member contacts the external adapter thereby preventing rotational movement of the external adapter and the clocking body relative to the termination body.

7. The cable assembly of claim 6, further comprising a second clocking adapter and a second external adapter.

8. The cable assembly of claim 6, wherein the termination body has an outer surface, and further comprising a braided shielding around the shielding and a jacket around the braided shielding, the jacket extending over at least a portion of the outer surface of the termination body.

9. The cable assembly of claim 8, wherein the clocking body has an outer surface and the jacket extends over at least a portion of the outer surface of the clocking body.

10. The cable assembly of claim 6, wherein the termination body has an outer surface, and further comprising a braided shielding around the shielding, a jacket around the braided shielding and a strain relief around at least a portion of the jacket, the strain relief extending over at least a portion of the outer surface of the termination body.

11. The cable assembly of claim 10, wherein the clocking body has an outer surface and the strain relief extends over at least a portion of the outer surface of the clocking body.

12. The cable assembly of claim 6, wherein the external adapter is an angled adapter and rotation of the external adapter relative to the termination body correlates to rotation of an output axis of the angled adapter relative to a plane through a major axis of the cable.

13. The cable assembly of claim 6, wherein the termination body has an outer surface knurled to receive at least one of a cable jacket and a stress relief.

14. The cable assembly of claim 6, wherein the clocking body has an outer surface knurled to receive at least one of a cable jacket and a stress relief.

* * * * *